United States Patent [19]

Hachmann et al.

[11] 4,003,841

[45] Jan. 18, 1977

[54] COATED STABILIZED BLEACH ACTIVATORS, PROCESS AND WASHING COMPOSITIONS

[75] Inventors: Klaus Hachmann, Hilden; Rolf Puchta, Haan; Gerhard Sperling, Hilden, all of Germany

[73] Assignee: Henkel & Cie G.m.b.H., Dusseldorf-Holthausen, Germany

[22] Filed: Aug. 6, 1975

[21] Appl. No.: 602,138

[30] Foreign Application Priority Data

Aug. 14, 1974 Austria ..... 6646/74

[52] U.S. Cl. ..... 252/94; 106/243; 252/95; 252/99; 252/186; 427/212; 428/403

[51] Int. Cl.[2] ..... C11D 3/395; C11D 7/18

[58] Field of Search ..... 252/94, 95, 99, 186; 427/212, 213; 106/243, 268; 428/403

[56] References Cited

UNITED STATES PATENTS

| | | | |
|---|---|---|---|
| 3,163,606 | 12/1964 | Viveen et al. | 252/99 |
| 3,459,665 | 8/1969 | Schiefer et al. | 252/94 |
| 3,833,506 | 9/1974 | Fries et al. | 252/95 |
| 3,847,830 | 11/1974 | Williams et al. | 252/186 |
| 3,847,830 | 11/1974 | Williams et al. | 252/95 |
| 3,925,234 | 12/1975 | Hachmann et al. | 252/99 |

*Primary Examiner*—Mayer Weinblatt
*Assistant Examiner*—Edith R. Buffalow
*Attorney, Agent, or Firm*—Hammond & Littell

[57] ABSTRACT

A coated stabilized bleaching assistant suitable for use in pulverulent washing and bleaching compositions comprising drop-shaped to globular-shaped particles having an average diameter of 0.01 mm to 2.5 mm, and at least 70% of which have a diameter within the range of 0.1 mm to 1 mm consisting of 10% to 70% by weight of at least one activator for active oxygen derived from compounds yielding $H_2O_2$ in aqueous solution, substantially surrounded by from 30% to 90% by weight of a mixture of (a) from 2 to 10 parts of substantially saturated fatty acids having 12 to 24 carbon atoms, (b) 1 part of aliphatic alcohols having 10 to 20 carbon atoms or their lower alkoxylated products having 1 to 5 alkoxy units, and (c) from 5 to 25% by weight of said mixture of water-soluble sulfates of aliphatic alcohols having from 8 to 18 carbon atoms or their lower alkoxylated products having 1 to 5 alkoxy units. The particles are obtained by spraying a fluid mixture of the components through a nozzle or by a spray disc, and cooling. The coated stabilized bleaching assistant can be incorporated with percompounds and other washing composition components.

14 Claims, No Drawings

COATED STABILIZED BLEACH ACTIVATORS, PROCESS AND WASHING COMPOSITIONS

Inorganic percompounds, especially perborates, are known as the active component of numerous bleaching agents, for example, those used for the bleaching and possibly for the simultaneous washing of textiles. Such bleaching agents have the disadvantage, however, that their bleaching action at temperatures below 80° C is relatively low. The addition of organic activators to such bleaching agents containing percompounds is known. These activators act in such a manner that the active oxygen of the percompound also becomes effective at temperatures below 80° C.

Washing compositions are known which contain, in addition to the usual detergent substances with a cleaning action, builder substances and the so-called bleaching activators causing percompounds to have a bleaching action. These activators are carboxylic acid derivatives which react with the percompounds with formation of peracids and, therefore, increase the bleaching action of the mixtures or make possible bleaching at relatively low washing temperatures. The storage of such washing compositions, however, causes considerable problems, since under the influence of relatively high air humidity, the percompounds and bleaching activators may react with one another even at room temperature, which leads to a loss of active oxygen. If substances susceptible to oxidation are added to the washing compositions, for example, optical brighteners, these may be oxidatively decomposed. In this case an unpleasant smell often occurs at the same time, which is due to volatile decomposition products. Trouble may also occur even in washing compositions in which the percompounds are enveloped with coating substances or are kept separate from the other washing components, in order to eliminate a mutual reaction with the other components. Since the bleaching activators are very reactive acylation agents, they may react with sensitive washing agent components, for example, perfumes or optical brighteners and adversely affect the properties of the latter.

It has already been proposed to purify the optical brighteners in a specified way in order to prevent the formation of unpleasant smelling products. However, the problem of a reduction of the active oxygen content is not thereby solved. Further, the suggestion has been made to provide the powder particles of the bleaching activator with a coating so as to suppress any mutual reaction between the activator and percompounds. Inorganic crystalline salts, for example, sodium sulfate, high molecular weight substances such as polyethyleneglycol, polyvinyl alcohol and cellulose ethers, or fatty substances such as fatty acids, fatty alcohols or fatty acid alkylolamides have been suggested as coating materials. In such case the coating material in dissolved form must be sprayed on or granulated on the activator. It has been found, however, that this pretreatment does not lead to an appreciable improvement of the stability on storage, especially when the coating material consists of water-soluble compounds. The use of water-insoluble coating substances leads indeed to an improvement of the storage stability in the known process. However, the coated particles do not dissolve or only dissolve very slowly in cold water and in moderately heated washing liquors, consequently the particles are deposited on the textiles and may lead to the formation of spots or stains and the bleaching effect is insufficient at low temperatures.

Copending, commonly-assigned United States Patent application Ser. No. 382,595, filed July 25, 1973, now U.S. Pat. No. 3,925,234, discloses and claims a stabilized bleaching assistant suitable for use in pulverulent washing and bleaching compositions comprising drop-shaped to globular-shaped particles at least 70% of which have a diameter within the range of 0.1 mm to 1 mm consisting essentially of 10% to 70% by weight of at least one activator for active oxygen derived from compounds yielding $H_2O_2$ in aqueous solutions having an activating action of at least 3, preferably from 4.5 to 8, in the Per-Acid Formation Test selected from the group consisting of N-acyl compounds having 2 to 9 carbon atoms in the acyl, O-acyl compounds having 2 to 9 carbon atoms in the acyl, carbonic acid esters and pyrocarbonic acid esters, substantially surrounded by from 30% to 90% by weight of a mixture of (a) from 2 to 10 parts by weight of said mixture of acids having substantially from 12 to 24 carbon atoms selected from the group consisting of substantially saturated fatty acids, saturated hydroxy fatty acids, and mixtures thereof and (b) 1 part by weight of said mixture of alcohols selected from the group consisting of substantially saturated aliphatic monohydric alcohols having from 10 to 20 carbon atoms, their ethoxylated products, their propoxylated products and mixtures thereof, where the alkoxylated products are water-insoluble and having from 1 to 5 alkoxy units; as well as a process for the production of the above stabilized bleaching assistant which consists of dispersing solid particles of said activator for active oxygen in a melt of said mixture of acids and alcohols, forming droplets of said dispersion at least 70% of which have a diameter within the range of 0.1 mm to 1 mm by means selected from the group consisting of (1) pressure spraying through a nozzle having an opening having a diameter of from 0.3 to 2.5 mm, preferably 0.6 to 1.8 mm, at a pressure of from 10 to 30 kg/cm$^2$, preferably 15 to 25 kg/cm$^2$, and (2) spraying from a spray disc rotating at a peripheral speed of from 5 to 150 m/sec, and cooling said droplets without contact below their solidifying temperature.

This process results in the above described drop-shaped to globular-shaped particles in which the particles of the bleach activators are covered by the solidified mixture of fatty acids and fatty alcohols. The process however suffers a drawback that the viscosity of the melt dispersion is low, thus making it difficult to obtain an average particle size with only a small range of particle sizes; and the product is only slowly dissolved and released in cold wash liquors at temperatures of about 30° C.

An object of the present invention is to develop a bleaching assistant composition which is protected against decomposition during storage and has a sufficient solubility in cold water.

A further object of the present invention is to develop a coated stabilized bleaching assistant suitable for use in pulverulent washing and bleaching compositions comprising drop-shaped to globular-shaped particles having an average diameter of 0.01 mm to 2.5 mm, and at least 70% of which have a diameter within the range of 0.1 mm to 1 mm consisting essentially of 10 to 70% by weight of at least one activator for active oxygen derived from compounds yielding $H_2O_2$in aqueous solutions having an activating action of least 3 in the Per-Acid Formation Test selected from the group consisting of N-acyl compounds having 2 to 9 carbon atoms in the acyl, O-acyl compounds having 2 to 9 carbon atoms in the acyl, carbonic acid esters and pyrocarbonic acid esters, substantially surrounded by from 30 to 90% by weight of a mixture of (a) from 2 to 10 parts by weight of said mixture of acids having substantially from 12 to 24 carbon atoms selected from the group consisting of substantially saturated fatty acids, saturated hydroxy fatty acids, and mixtures thereof, (b) 1 part by weight of said mixture of alcohols selected from the group consisting of substantially saturated aliphatic monohydric alcohols having from 10 to 20 carbon atoms, their ethoxylated products, their propoxylated products and mixtures thereof, where the alkoxylated products are water-insoluble and have from 1 to 5 alkoxy units, and (c) from 5 to 25% by weight of said mixture of water-soluble sulfates of alcohols selected from the group consisting of substantially saturated aliphatic monohydric alcohols having from 8 to 18 carbon atoms, their ethoxylated products, their propoxylated products and mixtures thereof, where the alkoxylated products have from 1 to 5 alkoxy units.

Another object of the invention is the development of pulverulent washing and bleaching compositions containing said coated stabilized bleaching assistant.

These and other objects of the invention will become more apparent as the description thereof proceeds.

According to the present invention, there is provided a coated bleaching assistant suitable for use in pulverulent washing and bleaching compositions which comprises drop-shaped to globular-shaped particles of which at least 70% have an average diameter of 0.1 to 1 mm, and not more than 30% have a diameter of not less than 0.01 and not more than 2.5 mm, and are constituted as follows: 10 to 70% by weight of at least one compound from the class of organic N-acyl and 0-acyl compounds with an organic acyl R—CO—, where R designates a hydrocarbon radical with from 1 to 8 carbon atoms, optionally substituted with alkoxy having from 1 to 3 carbon atoms, halo, nitro or cyano as well as carbonic acid esters and pyrocarbonic acid esters, which act as an activator for percompounds, the activation value of which for the percompounds amounts to more than 3 in the Per-Acid Formation Test, substantially coated with 30 to 90% by weight of a mixture of substantially saturated fatty acids and hydroxy-fatty acids having 12 to 24 carbon atoms and aliphatic alcohols having 10 to 20 carbon atoms or their lower alkoxylated products in the proportion by weight of 10:1 to 2:1, where the lower alkoxylated products contain from 1 to 5 alkoxy units, characterized in that the covering material contains water-soluble sulfates of fatty alcohols with 8 to 18, preferably 12 to 18 carbon atoms or their ethoxylated or propoxylated adducts with 1 to 5 alkoxy units in the molecule, these sulfates representing 5 to 25%, preferably 10 to 20% of the covering material.

More particularly, the invention comprises a coated stabilized bleaching assistant suitable for use in pulverulent washing and bleaching compositions comprising drop-shaped to globular-shaped particles having an average diameter of 0.01 mm to 2.5 mm, and at least 70% of which have a diameter within the range of 0.1 mm to 1 mm consisting essentially of 10 to 70% by weight of at least one activator for active oxygen derived from compounds yielding $H_2O_2$ in aqueous solution having an activating action of least 3 in the Per-Acid Formation Test selected from the group consisting of N-acyl compounds having 2 to 9 carbon atoms in the acyl, O-acyl compounds having 2 to 9 carbon atoms in the acyl, carbonic acid esters and pyrocarbonic acid esters, substantially surrounded by from 30 to 90% by weight of a mixture of (a) from 2 to 10 parts by weight of said mixture of acids having substantially from 12 to 24 carbon atoms selected from the group consisting of substantially saturated fatty acids, saturated hydroxy fatty acids, and mixtures thereof, (b) 1 part by weight of said mixture of alcohols selected from the group consisting of substantially saturated aliphatic monohydric alcohols having from 10 to 20 carbon atoms, their ethoxylated products, their propoxylated products and mixtures thereof, where the alkoxylated products are water-insoluble and have from 1 to 5 alkoxy units, and (c) from 5 to 25% by weight of said mixture of water-soluble sulfates of alcohols selected from the group consisting of substantially saturated aliphatic monohydric alcohols having from 8 to 18 carbon atoms, their ethoxylated products, their propoxylated products and mixtures thereof, where the alkoxylated products have from 1 to 5 alkoxy units.

The coated bleaching assistants are preferably present in the mixture together with further pulverulent bleaching agent components, especially granular to pulverulent percompounds which liberate hydrogen peroxide in aqueous solution. In these mixtures the proportion by weight of the coated bleaching assistant to the percompound should amount to 1:5 to 5:1 and be chosen so that 0.05 to 2 mols of activator are present per gram atom of active oxygen. These solid, pulverulent-to-granular compositions useful in the preparation of aqueous cold-bleaching baths, especially cold-bleaching washing liquors for textile consist essentially of (I) from 5 to 95% by weight of the above coated stabilized bleaching assistant, and (II) from 5 to 95% by weight of at least one compound selected from the group consisting of (a) alkali metal builder salts, (b) percompounds giving $H_2O_2$ in aqueous solutions and stabilizers for percompounds, (c) tensides selected from the group consisting of anionic surface-active compounds, non-ionic surface-active compounds and amphoteric surface-active compounds, (d) optical brighteners, (3) water-soluble organic builder salts, (f) antimicrobial agents, (g) soil suspension agents, (h) enzymes, (i) foam inhibitors, (k) textile softeners, and (l) corrosion inhibitors.

The fatty alcohols from which the above mentioned water-soluble sulfates originate, as well as the free fatty alcohols existing in the covering mixture are preferably of a saturated nature. The water-soluble sulfates are in particular the alkali metal salts, ammonium salt and the fatty alcohol sulfates in the form of their sodium salts are preferred.

The addition of the above defined fatty alcohol sulfates or fatty alcohol alkoxylated sulfates increases the viscosity of the mixture of activator, molten fatty acid and molten alcohol.

It has been found expedient to select the amounts of activator and sulfates in inverse proportion, that is, small amounts of the water-soluble sulfates are used with high activator contents and vice versa. With activator contents of 40 to 60% (based on the total coated bleaching assistant), water-soluble sulfate contents of 20 to 10% (based on the coating mixture) can be used.

The improvement according to the invention manifests itself both in the preparation and in the properties of the products obtained. If the melting point of the activator to be used is much higher than that of the coating mixture, as it is the case, for example, with tetraacetyl glycoluril, a suspension of the solid activator in the molten material must be processed. There is a risk of separation, particularly in storage vessels and in transportation in pipe lines. This risk is greatly reduced by the addition of the viscosity-increasing fatty alcohol sulfates according to the invention. In addition, the fatty alcohol sulfates improve the properties of the products in use: they raise the rate of dissolution in water of the coated bleaching assistant, so that the activator is available in a short time after the coated bleaching assistant according to the invention has been introduced into the treatment liquor, particularly when working in a temperature range of 30° C.

The activators for percompounds utilizable according to the invention are certain compounds of the N-acyl and O-acyl type as well as carbonic acid esters of pyrocarbonic acid esters, indicated below under (a) to (o), which have an activation value in the Per-Acid Formation Test of at least 3, preferably at least 4.5 to 8.

substituted R residues are, for example, chloroalkyl having 1 to 3 carbon atoms, m-chlorophenyl, p-nitrophenyl, and p-methoxyphenyl.

Of the activators described below, compounds with a melting point of at least 70° C, preferably at least 100° C and especially at least 150° C, are specially suitable. Furthermore, the equivalent weight of these compounds should be not more than 170, preferably not more than 130 and especially not more than 110 (the equivalent weight is here the quotient of the molecular weight and the number of R—CO— residues present in the molecule where the compound is N-acylated or O-acylated).

The types of compound mentioned under (a) to (o) are useful activators according to the invention. In the formulae the numbered residues R have the meaning given for R above unless specifically otherwise indicated. If several residues R are present in a molecule, they may be the same or different.

a. N-diacylated amines of the formula I, in which X represents a residue R or one of the residues Ia, Ib or Ic.

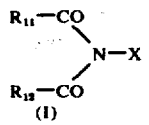
(I)

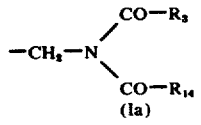
(Ia)

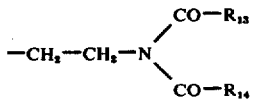
(Ib)

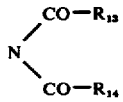
(Ic)

PER-ACID FORMATION TEST

The activation value (= titre) for the activators is determined in the following way:

Solutions which contain 0.615 gm/liter of $NaBO_2 \cdot H_2O_2 \cdot 3H_2O$ (4 mMol/liter) and 2.5 gm/liter of $Na_4P_2O_7 \cdot 10\ H_2O_2$, are heated to 60° C, and then are mixed with 4 mMol/liter of activator and maintained at the said temperature for 5 minutes with stirring. Then 100 ml of this liquid is added to a mixture of 250 mg of ice and 15 ml of glacial acetic acid and titrated immediately after addition of 0.35 gm of potassium iodide with 0.1 N sodium thiosulfate solution, using starch as indicator. Under the given experimental conditions, for a 100% activation of the peroxide used, 8.0 ml of thiosulfate solution are consumed, the titre is 8.0. This maximum value is, of course, seldom attained. Good activators have a titre of at least 4.5, preferably from 5.7. Useful results are often obtained with activators having a titre of at least 3.0.

Activators of the N-acyl or O-acyl compounds type contain an acyl residue R—CO—, in which R represents optionally substituted hydrocarbon residues with 1 to 8 carbon atoms. If the residues R are aliphatic, they preferably have 1 to 3 carbon atoms, and if they are aromatic, they may contain up to 8 carbon atoms. Consequently, the residue R is preferably one of the following: lower alkyl, such as methyl, ethyl, n-propyl or isopropyl; phenyl; alkylphenyl such as toluyl or xylyl residues. Suitable substituents for both aliphatic and aromatic residues are $C_{1-3}$ alkoxy groups, halogen atoms, nitro or nitrile groups; when R is an aromatic residue, it may be chloro- and/or nitro-substituted, especially m-chloro or m- or p-nitro-substituted. Such From this class of compounds, N, N, N',N'-tetraacetylmethylenediamine (melting point 92° to 95° C), N,N,N', N'-tetraacetylethylenediamine, N,N-diacetylaniline and N,N-diacetyl-p-toluidine are named as examples.

b. N-acylhydantoins of formula II, in which at least one of the residues $X_{21}$ and $X_{22}$ represent an R—CO— residue, while the other may also represent a residue R or a carboxymethyl or a lower alkoxycarbonylmethyl residue; $Y_{21}$ and $Y_{22}$ represent hydrogen or alkyl residues with 1 to 2 carbon atoms.

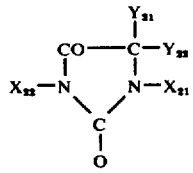
(II)

Suitable compounds are, for example, 1,3-diacetyl-5,5-dimethylhydantoin, 1,3-dipropionylhydantoin (melting point 104.5° to 106° C) and 3-benzoylhydantoin-1-acetic acid ethyl ester.

c. N-alkyl-N-sulfonyl-carbonamides of formula III, in which $R_{33}$ preferably signifies a $C_{1-3}$ alkyl residue.

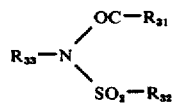
(III)

Activators of this type are, for example, N-methyl-N-mesylacetamide (melting point 73° to 79° C), N-methyl-N-mesylbenzamide (m.p. 116° to 118.5° C), N-methyl-N-mesyl-p-nitrobenzamide (m.p. 159° to 160° C) and N-methyl-N-mesyl-p-methoxybenzamide (m.p. 117° to 117.5° C).

d. Cyclic N-acylhydrazides of formula IV, in which the two nitrogen atoms are part of a 5- or 6-membered hetero ring from the group of maleic acid hydrazide, phthalic acid hydrazide, triazole or urazole.

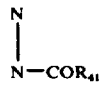

(IV)

A suitable compound, for example, is mono-acetylmaleic acid hydrazide.

e. O,N,N-trisubstituted hydroxylamines of formula V, in which $R_{53}$ represents a residue R, preferably a methyl or ethyl residue, an optionally substituted aryl residue or the group Va, while $X_{51}$ and $X_{52}$ represent one of the residues R—CO—, R—$SO_2$— or one of the above-described aromatic residue, or each can be linked with the corresponding residue $R_{51}$ or $R_{52}$ to give a succinyl or phthalyl residue and n signifies a whole number from 0 to 2.

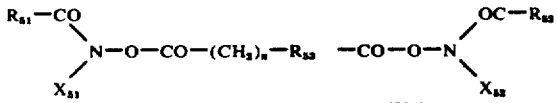

(V) (Va)

Activators of this type are, for example, O-benzoyl-N,N-succinyl-hydroxylamine (m.p. 137° to 139° C), O-acetyl-N,N-succinyl-hydroxylamine (m.p. 132° to 134° C), O-p-methoxybenzoyl-N,N-succinyl-hydroxylamine (m.p. 142° to 145° C), O-p-nitrobenzoyl-N,N-succinyl-hydroxylamine (m.p. 212° to 215° C) and O,N,N-triacetyl-hydroxylamine.

f. N,N'-diacyl-sulfurylamides of formula VI, in which $R6_1$ and $R6_3$ preferably represent $C_{1-4}$ alkyl residues or aryl residues such as phenyl, while $R_{62}$ and $R_{64}$ preferably represent $C_{1-5}$ alkyl residues, especially $C_{1-3}$ alkyl residues.

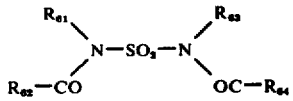

(VI)

N,N'-dimethyl-N,N'-diacetyl-sulfurylamide (m.p. 58° C to 60° C) and N,N'-diethyl-N,N'dipropionyl-sulfurylamide (m.p. 95° to 97° C) may be mentioned as examples.

g. Triacyl-cyanurates of formula VII

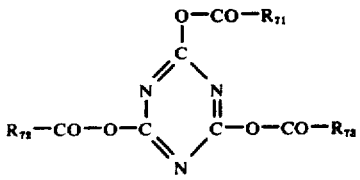

(VII)

where $R_{71}$, $R_{72}$ and $R_{73}$ are R, for example, triacetyl- or tribenzoyl-cyanurate.

h. Optionally substituted anhydrides of benzoic or phthalic acids, especially benzoic acid anhydride itself, m-chlorobenzoic acid anhydride (m.p. 95° C), phthalic acid anhydride or 4-chlorophthalic acid anhydride.

i. Sugar esters esterified with two or more acyls, OC—R, for example, glucosepentaacetate.

j. 1,3-Diacyl-4,5-diacyloxy-imidazolidines of formula VIII in which $X_{80}$ represents hydrogen, or R, and $R_{80}$ and $R_{83}$ represent hydrogen or R.

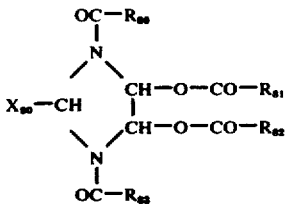

(VIII)

To these belong 1,3 -diformyl-4,5-diacetoxy-imidazolidine (m.p. 160° to 165.5° C), 1,3-diacetyl-4,5-diacetoxyimidazolidine (m.p. 139° to 140.5° C), 1,3-diacetyl-4,5-dipropionyloxy-imidazolidine (m.p. 85° to 87° C).

k. Acylated glycolurils of the general formula IX, in which $X_{91}$ represents the residue R or R—CO.

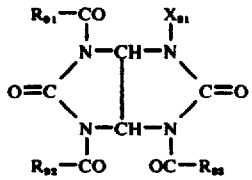

(IX)

tetraacylated glycolurils and especially tetraacetyl-glycoluril (m.p. 233° to 240° C) are preferably used. In addition, the following acylated glycolurils are suitable:

di-(chloracetyl)-diacetyl-glycoluril (m.p. 267° to 269° C), tetrapropionyl-glycoluril (m.p. 144° to 146° C), 1-methyl-3,4,6-triacetylglycoluril (m.p. 179° to 180° C), diacetyl-dipropionylglycoluril (m.p. 144° to 146° C), and diacetyl-dibenzoyl-glycoluril (m.p. 244° to 249° C).

The acylated glycolurils are not only of special practical importance on account of their excellent properties as activators, but owing to their high melting point, they are very suitable for the preparation of pulverulent products which are stable on storage.

l. Diacylated 2,5-diketopiperazines of the general formula X

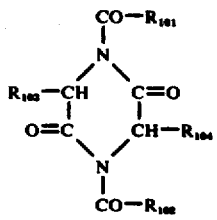

(X)

in which $R_{101}$ and $R_{102}$ are R and $R_{103}$ and $R_{104}$ are hydrogen, alkyl having 1 to 3 carbon atoms, hydroxyalkyl having 1 to 3 carbon atoms, haloalkyl having 1 to 3 carbon atoms, nitroalkyl having 1 to 3 carbon atoms, nitriloalkyl having 2 to 4 carbon atoms and alkoxyalkyl having 2 to 5 carbon atoms, for example: 1,4-diacetyl-2,5-diketopiperazine, 1,4-dipropionyl-2,5-diketopiperazine (m.p. 113° to 114.5° C) and 1,4-dipropionyl-3,6-dimethyl-2,5diketopiperazine (m.p. 113° to 114° C).

m. N-acylated 2,4,6,8-tetraaza-bicyclo-(3,3,1)-nonan-3,7-diones of the general formula XI

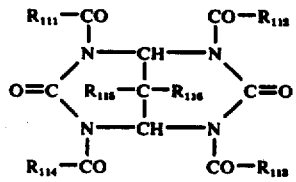

(XI)

in which $R_{111}$, $R_{112}$, $R_{113}$ and $R_{114}$ are R and $R_{115}$ and $R_{116}$ are hydrogen or methyl, for example:

2,4,6,8-tetraacetyl-2,4,6,8-tetraaza-bicyclo-(3,3,1)-nonan-3,7-dione (m.p. 181° to 183° C), 2,4,6,8-tetrapropionyl-2,4,6,8-tetraaza-bicyclo-(3,3,1)-nonan-3,7-dione (m.p. 144.5° to 146° C), 2,4,6,8-tetraacetyl-9,9-dimethyl-2,4,6,8-tetraaza-bicyclo-(3,3,1)-nonan-3,7-dione (m.p. 180° to 183° C), and 2,4,6,8-tetrabenzoyl-2,4,6,8-tetraaza-bicyclo-(3,3,1)-nonan-3,7-dione (m.p. 234° to 236.5° C).

n. Carbonic acid esters of formula XII, in which $X_{21}$ represents an electron-attracting residue, preferably selected from the group p-carboxyphenyl, p-sulfophenyl or alkoxycarbonyl with 1 to 4 carbon atoms in the alkoxy group:

$$X_{121}-\Phi-CO-O-R_{122} \qquad (XII)$$

For example, p-ethoxycarbonyloxy-benzoic acid (m.p. 157° C) and p-propoxycarbonyloxy-benzene sulfonic acid.

o. Pyrocarbonic acid esters of $C_1$ to $C_4$ alkanols as, for example, pyrocarbonic acid ethyl ester.

Tetraacetylglycoluril mentioned under (k) is of particular interest.

In the activation of the percompounds in aqueous solutions by the said N-acyl and O-acyl compounds, carboxylic acids as, for example, acetic acid, propionic acid and benzoic acid, are liberated and it is advisable to add corresponding amounts of alkali to bind these carboxylic acids. In the case of effective activators, an activation is already to be noted when amounts of 0.05 mol of activator per gram atoms of active oxygen are used. It is preferred to work with 0.1 to 1 mol of activator, but the amount may also be increased to 2 mols of activator per gram atom of active oxygen.

Suitable fatty acids, which are present in the activator-containing powder particles, are saturated fatty acids and saturated hydroxy-fatty acids having 12 to 24 carbon atoms, as well as their mixtures, such as lauric, myristic, palmitic, stearic arachidic, behenic and lignoceric acid and also hydroxystearic and dihydroxystearic acids. When mixtures of naturally occurring or hydrogenated fatty acids are used, these may also contain some saturated fatty acids with 8 to 10 carbon atoms or some unsaturated fatty acids with 8 to 24 carbon atoms, for example, oleic acid, but the fraction of the low molecular weight acids or unsaturated acids or both should be less than 20% by weight and especially less than 10% by weight of the total fatty acids present. The composition of the fatty acid mixtures should preferably be such that the softening point of melting point is above 40° C.

The substantially saturated aliphatic monohydric alcohols having from 10 to 20 carbon atoms, possibly alkoxylated, present in admixture with the bleaching activator and the fatty acids may be of natural or synthetic origin, such as decyl, lauryl, myristyl, cetyl and arachyl (anachidyl) alcohols, and their mixtures, for example, coconut or tallow alcohols, and also oxo-alcohols or alcohols from paraffin oxidation. Small portions, up to 10%, of unsaturated alcohols may be present. The alcohols are preferably saturated. When alkoxylated, that is, ethoxylated and/or propoxylated, alcohols are used, the number of alkylene oxide groups, especially ethylene oxide groups, should be chosen so that no water-soluble compounds are present, i.e., they should not amount to more than 5, preferably not more than 3. Mixtures of non-alkoxylated and alkoxylated alcohols are also useful. Preferably saturated fatty alcohols having 12 to 18 carbon atoms and their mixtures are utilized.

The proportion by weight of fatty acid to alcohol or ethoxylated alcohol should amount to 10:1 to 2:1, preferably 5:1 to 3:1.

The fatty alcohol sulfates and fatty alcohol alkoxylated sulfates are preferably derived from the same fatty alcohols and fatty alcohol mixtures as mentioned above, and contain 8 to 18, preferably 12 to 18 carbon atoms. As far as alkoxylated sulfates are used, the ethoxylated sulfates are preferred. Examples of these sulfates are lauryl-diethylene glycol ether sulfate, myristyl-diethylene glycol ether sulfate, cetyl-diethylene glycol ether sulfate, etc. in the form of their sodium salts.

The activator containing particles of the stabilized bleaching assistant of the invention should be present approximately in drop of globular shape and at least 70% by weight should have a diameter with the range of 0.1 mm to 1 mm, and, preferably more than 90% by weight, should have an average diameter of 0.1 mm to 1.6 mm. Their composition should be largely homogeneous, and the surface should be smooth. Powder particles which fulfill these requirements are obtainable by homogenizing the bleaching activator, the fatty acid, the possibly alkoxylated alcohol and the water-soluble sulfate at a temperature which lies above the melting points of the fatty acid and the alcohol and preferably below the melting point of the bleaching activator and spraying, for example, by means of a nozzle under high pressure into a fall space, in which the temperature lies below that of the solidifying point of the mixture of fatty acid, alcohol and sulfate.

The aperature of the spray nozzle should have to diameter of 0.3 mm to 2.5 mm, preferably 0.6 mm to 1.8 mm. The pressure with which the dispersed melt is fed to the nozzle should amount to 10 to 30, preferably 15 to 25, kg/cm². Instead of a nozzle, a rotating spray disc, which may be provided with round or slot-like orifices, may also be used. The peripheral speed of such a disc, which has usually a diameter of 150 to 300 mm, and rotates at 800 to 10,000 revolutions per minute, should be 5 to 150 m/sec., preferably 10 to 100 m/sec. The fall space, in which the sprayed particles solidify, suitably consists of a cylindrical chamber, which is fitted with supply lines for cooling air and a discharge device for the powder, arranged at the conical base of the chamber. The cooling air, the temperature of which lies at least 10° C below the solidifying temperature of the mixture of fatty acid and alcohol and, for example, ranges from −10° to +40° C, may be led in the same direction or counter-current.

When technically pure starting materials are used, the sprayed particles may be naturally colored. By addition of dyestuffs or colored pigments before the spraying or dusting of the grains obtained with pigments, for example, titanium oxide, the natural color may be masked or altered.

The stablized bleaching assistants may be present alone, in admixture with percompounds or in admixture with pulverulent to granular washing compositions with or without bleaching agents. These washing compositions consist of at least one compound from the class of anionic, amphoteric and non-ionic surface-active compounds, at least one compound from the class of polymeric phosphates, sequestering agents and washing alkalis and at least one compound from the class of optical brighteners.

In addition to alkali metal paroxides, the most suitable percompounds which liberate hydrogen peroxide in aqueous solution are the perhydrates, for example, anhydrous or crystalline sodium perborate, also alkali metal percarbonates, perpyrophosphates and persilicates and urea perhydrate. Sodium perborate tetrahydrate is preferably used.

The average particle size of the percompounds and the possibly additionally used powder components should amount to 0.1 to 2 mm. The granular size of the percompounds as well as of possible further powder components is not in itself critical, but should be chosen so that at least 50% and preferably more than 80% of the particles have a diameter of at least 0.05 and not more than 2.5 mm, in order to prevent a dust formation, on the one hand, and on the other hand, to keep the powder mixture easy to transport and pourable. Relatively large variations in the grain size of the individual powder components should be avoided in order to prevent an undesired settling of fines and specifically heavier particles to the bottom of the packing container during transport.

The union of the various powder components into a homogeneous powder mixture or the addition of further powder components is effected in known way by the usual mixing devices, while the structure of the individual components should be preserved as far as possible.

Preparations which comprise substantially the stabilized bleaching assistant, are suitable for use in the textile industry or in industrial laundries, where they are used together with hydrogen peroxide or solid percompounds and possibly the usual additions for the preparation of the bleaching baths and bleaching washing baths.

If, in addition to the stablized bleaching assistant, according to the invention, the compositions of the invention contain other constituents usually present in bleaching baths, the composition of such preparation lies approximately in the range of the following formulation:

5 to 95%, preferably 5 to 50%, by weight of a stabilized bleaching assistant defined above, 95 to 5%, preferably 93 to 50%, by weight of neutral and/or preferably alkaline-reacting builder salts and possibly other constituents usual in bleaching or bleaching washing compositions, such as, for example, surface-active compounds, soil suspension agents, foam stabilizers, dyestuffs and perfumes and so forth.

When in the above formulation the inorganic builder salts are wholly or partly replaced and present as percompounds yielding $H_2O_2$ in aqueous solution, the preparations according to the invention represent specially interesting bleaching compositions for practical purposes, which on dissolving in water give cold-bleaching washing liquors, in which the active oxygen is already effective at temperatures from 20° 70° C, especially 30° to 60° C.

In such bleaching compositions the ratio of the activator in the stablized bleaching assistant of the invention to the percompound is always such that from 0.05 to 2 mols, preferably 0.1 to 1 mol, of activator is present per gram-atom of active oxygen of the percompound.

When such bleaching compositions contain more than 40% by weight of activator and percompound, this quantity relating to the pure activator and the pure percompound without the other constituents of the stabilized bleaching assistant, these preparations are preferably used as bleaching agent concentrates in the textile industry or in industrial laundries.

When the bleaching compositions of the invention contain up to 40% by weight of pure activator and percompound in the above-defined ratios, they are useful as bleaching washing compositions and washing assistants, which are of special practical interest and, therefore, represent a preferred field of application of the present invention. In such bleaching washing compositions and washing assistants, the proportions of activator and percompound constitute together mostly from 5 to 40%, especially from 10 to 35%, by weight of the composition. The composition of such bleaching agents generally lies within the range of the following formulation, the constituents of the granulate of the above-defined activator component being distributed according to the formulation in the various categories listed below:

5 to 40%, preferably 7 to 30%, by weight of a surface-active component, containing at least one surface-active compound of the type of the sulfonates, sulfated, soaps, non-ionics and, optionally, one or more of the following substances:

0 to 10%, preferably 0.5 to 8%, by weight of foam stabilizers, 0 to 10%, preferably 0.5 to 8%, by weight of non-surface-active foam inhibitors, 5 to 40%, preferably 10 to 35%, by weight of pure activator and percompound, 10 to 80%, preferably 35 to 75%, by weight of builder salts, these substances being preferably alkaline-reacting and the amount of these substances preferably constituting 0.5 to 7 times, and especially 1 to 5 times, the total amount of surface-active compounds, and 0 to 30%, preferably 3 to 15%, by weight of other bleaching and washing compositions constituents such as, for example, soil suspension agents, textile softeners, enzymes, optical brighteners, dyestuffs and perfumes, water, where the activator in the above-defined stabilized bleaching assistant is present in an amount corresponding to 0.05 to 2 mols, preferably 0.1 to 1 mol per gram-atom of active oxygen of the percompound.

In this general formulation are also included bleaching fine washing compositions to be used at temperatures up to 70° C, the surface-active compound content of which is generally in the range from 8 to 40% to 40%, by weight. Provided these fine washing compositions are not intended for use in washing machines, especially in drum washing machines, they need not also contain foam inhibitors. Bleaching softening or after-rinsing compositions have usually a surface-active compound content of less than 5% by weight, and they also need not contain foam inhibitors.

The bleaching washing compositions intended for use in washing machines, preferably in drum washing machines, are of particular practical importance in which the surface-active compound component constitutes usually 7 to 30% by weight. These mostly contain at least one of the following two types of surface-active compound in the amounts there indicated:

15 to 100%, preferably 35 to 90%, by weight of a sulfonate and/or a sulfate with preferably 8 to 18 carbon atoms in the hydrophobic residue, 10 to 50%, by weight of nonionics and optionally one or more of the following substances:

5 to 70%, preferably 10 to 60%, by weight of a soap, 0 to 10%, preferably 0.5 to 8%, by weight of a form stabilizer, 0 to 10%, preferably 0.5 to 8%, by weight of a non-surface-active foam inhibitor, the foaming power, however, of the surface-active component being reduced either by simultaneous presence of different surface-active compounds reducing the foaming power and/or foam-inhibiting soap and/or non-surface-active foam inhibitors.

The said bleaching washing compositions are generally prepared by mixing the stabilized bleaching assistant according to the invention with granular percompounds and washing compositions which have been obtained by admixing a washing composition powder prepared by hot spray drying. Such cold-bleaching washing compositions are marked by a good stability on storage.

The further constituents of the compositions according to the invention are described below in more detail according to the class of substance.

Suitable detergent substances which may be used in the washing agent-containing powder components are those anionic surface-active compounds of the sulfonate or sulfate type, for example, alkylbenzenesulfonates, especially n-dodecylbenzenesulfonate, and also olefinsulfonates, such as are obtained, for example, by sulfonation of primary or secondary aliphatic monoolefins with gaseous sulfur trioxide and subsequent alkaline or acid hydrolysis, as well as alkylsulfonates, such as are obtainable from n-alkanes by sulfochlorination or sulfoxidation and subsequent hydrolysis or neutralization, or by addition of bisulfite to olefins. Further, α-sulfo-fatty acid esters, primary and secondary alkylsulfates, and the sulfates of ethoxylated or propoxylated higher molecular weight alcohols and alkylphenols are suitable.

Further suitable anionic surface-active compounds are alkali metal soaps from fatty acids of natural of synthetic origin, for example, the sodium soaps of coconut, palm kernel or tallow fatty acids. Suitable amphoteric surface-active compounds are alkylbetaines and especially alkylsulfobetaines, for example, 3-(N,N-dimethyl-N-alkylammonium)-propane-1-sulfonate and 3-(N,N-dimethyl-N-alkylammonium)-2-hydroxypropane-1-sulfonate.

The anionic surface-active compounds may be present as the alkali metal salts such as the sodium and potassium salts and ammonium salts as well as salts of organic bases, for example, lower alkanolamines, such as mono-, di- or tri-ethanolamines. If the said anionic and amphoteric compounds contain an aliphatic hydrocarbon residue, this should preferably have a straight chain and contain 8 to 22 carbon atoms. In the compounds with an araliphatic hydrocarbon residue, the preferably unbranched alkyl chains contain an average of 6 to 16 carbon atoms.

The most important non-ionic surface-active compounds are the polyglycolether derivatives of alcohols, fatty acids and alkylphenols, which contain 3 to 30 ethoxy units, and 8 to 20 carbon atoms in the hydrocarbon residue. Polyglycolether derivatives are particularly suitable in which the number of ethoxy units amounts to 5 to 15 and the hydrocarbon residues of which are derived from straight-chain primary alkanols having 12 to 18 carbon atoms or from alkylphenols having a straight alkyl chain having 6 to 14 carbon atoms.

Further suitable non-ionic surface-active compounds are the water-soluble polyethyleneoxide adducts to polypropyleneglycol, ethylenediaminepolypropyleneglycol and alkylenepolypropyleneglycol with 1 to 10 carbon atoms in the alkylene chain, which adducts contain 20 to 250 ethoxy units and 10 to 100 propoxy units. The said compounds usually contain 1 to 5 ethoxy units per propoxy unit. Non-ionic compounds of the amineoxide and sulfoxide type, which may possibly also be ethoxylated, are also utilizable.

In addition, alkali metal polymeric phosphates may be contained in the powder component containing washing agents, especially pentasodium tripolyphosphate. The tripolyphosphates may also be present in admixture with higher condensed phosphates, such as tetrahpolyphosphates, or their hydrolysis products, such as acid or neutral pyrophosphates.

The condensed phosphates may also be replaced wholly or partly by sequestering agents, for example, aminopolycarboxylic acids and their alkali metal salts. These include especially alkali metal salts of nitrilotriacetic acid and ethylenediaminetetraacetic acid. Further, the salts of diethylenetriamine-pentaacetic acid and the higher homologs of the said aminopolycarboxylic acids are suitable. These homologs may be prepared, for example, by polymerization of an ester, amide or nitrile of N-acetic acid-aziridine and subsequent saponification to give carboxylic acid salts or by reaction of polyamines such as polyethyleneimine with a molecular weight of 500 to 10,000 with salts of chloroacetic acids or bromoacetic acids in alkaline medium. Further suitable aminopolycarboxylic acids are poly-(N-succinic acid)-ethylaneimine and poly-(N-tricarballylic acid)-ethyleneimine of average molecular weight 500 to 500,000, which are obtainable similarly to the N-acetic acid derivatives.

Further, nitrogen-free compounds may be used as sequestering agents, for example, the water-soluble alkali metal salts, such as potassium and especially sodium salts of polyvalent hydroxycarboxylic acids or ethercarboxylic acids, such as citric acid, gluconic acid, glucuronic acid and hydroxydiacetic acid, as well as of higher molecular weight polycarboxylic acids, for example, of polymerizates of ethylenic mono-, di- and tricarboxylic acids, such as acrylic acid, maleic acid, fumaric acid, itaconic acid, citric acid, aconitic acid, mesaconic acid and methylenemalonic acid. Copolymerizates of these carboxylic acids with one another or with other copolymerizable substances as, for example, ethylenically unsaturated hydrocarbons, such as ethylene, propylene, isobutylene and styrene, with ethylenic monocarboxylic acids, such as acrylic acid, methacrylic acid, crotonic acid and 3-butencarboxylic acid or with other ethylenically unsaturated alcohols, ethers, esters, amides and nitriles, such as vinyl alcohol, allyl alcohol, vinylmethylether, acrolein, vinyl acetate, acrylamide and acrylonitrile, can also be used. Copolymerizates from ethylenic mono-, di- and tricarboxylic acids and several ethylenically unsaturated compounds of different structure are also suitable. The polymerizates and copolymerizates have an average degree of polymerization of 3 to 6,000 and should contain 1 to 9, preferably 2 to 9, carboxyl groups capable of forming salts, for every 3 monomer units.

So-called washing alkalis may be mentioned as further builder salts, such as the alkali metal silicates, especially sodium silicate, in which the ratio of $Na_2O$ to $SiO_2$ amounts to 1:3.5 to 1:1, and also carbonates, bicarbonates and borates of alkali metals such as sodium or potassium. The amount of alkaline-reacting substances including the washing alkalis and phosphates should be such that the pH value of a usable alkali liquor amounts to 9 to 11 during the washing process does not fall below values under 8 on account of consumption of alkali through the hydrolysis of the bleaching activator.

Increased effects may in many cases be obtained by suitable combination of different surface-active washing substances or builder salts with one another, for example, an improved washing power or a reduced foaming capacity. Such improvements are possible, for example, by combination of anionic with non-ionic and/or amphoteric surface-active compounds with one another or by mixing washing substances of the same type, which differ with respect to their structure in the number of carbon atoms, the number and position of the double bonds or chain branchings in the hydrocarbon residue. Mixtures of inorganic and organic builder salts with a synergistic action may be used or may be combined with the above-mentioned mixtures.

The washing compositions may also contain optical brighteners, especially derivatives of diaminostilbenedisulfonic acid or their alkali metal salts of the formula

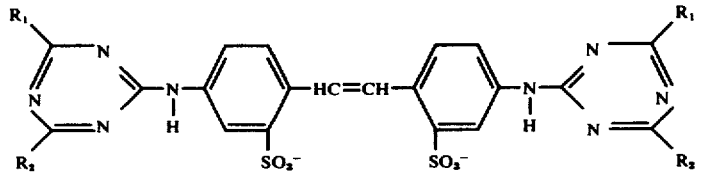

wherein $R_1$ and $R_2$ may represent halogen atoms, lower alkoxy groups, the amino group or radicals of aliphatic, aromatic or heterocylic primary or secondary amines as well as radicals of aminosulfonic acids where the aliphatic radicals, present in the above groups, contain preferably 1 to 4, and particularly 2 to 4 carbon atoms, while the heterocylic ring systems are primarily rings with 5 or 6 members. As aromatic amine radicals preferably aniline, anthranilic acid or anilinesulfonic acid are of interest. Brighteners derived from the diaminestilbene sulfonic acids are mostly used as brighteners for cotton. The following products, derived from formula I, are commercially available, where $R_1$ represents the residue $-NH-C_6H_5$ and $R_2$ represents the following:

$-NH_2$ $-NH-CH_3$ $-NH-CH_2-CH_2OH$ $-NH-CH_2-CH_2-O-CH_3$ $-NH-CH_2-CH_2-CH_2-O-CH_3$ $CH_3-\overset{|}{N}-$ $-N=(CH_2-CH_2OH)_2$ morpholino- $-NH-C_6H_5$ $-NH-C_6H_4-SO_3H$ $-OCH_3$ For example, salts of 4,4'-bis-(2''-anilino-4''-morpholino-1,3,5-triazinyl-6''-amino)-stilbene-2,2'-disulfonic acid, or similarly constructed compounds, which instead of the morpholino group contain a diethanolamine group, a methylamino group or a β-methoxyethylamine group are suitable. Furthermore, suitable brighteners for polyamide fibers are those of the diarylpyrazoline type, for example, 1-(p-sulfonamidophenyl)-3-(p-chlorophenyl)-$\Delta^2$-pyrazoline, as well as similarly constructed compounds which, instead of the sulfonamido group, contain a carboxymethyl or acetylamino group.

In addition, substituted aminocoumarins, for example, 4-methyl-7-dimethylaminio-coumarin or 4-methyl-7-diethylamino-coumarin, are useful. Further, the compounds 1-(2-benzimidazolyl)-2-(1-hydroxyethyl-2-benzimidazolyl)-ethylene and 1-ethyl-3-phenyl-7-diethylamino-carbostyril are useful as polyamide brighteners. The compounds 2,5-di-(2-benzoxazolyl)-thiophene, 2-(2-benzoxazolyl)-naphtho[2,3-b]-thiophene and 1,2-di-(5-methyl-2-benzoxazolyl)-ethylene are suitable as brighteners for polyester and polyamide fibers. Brighteners of the substituted diphenylstyril type may also be present. Mixtures of the above-mentioned brighteners may also be used.

These optical brighteners are present in the products of the invention, particularly in the washing agents, according to the invention, generally in amounts of from 0.05 to 1.5%, preferably from 0.07 to 1% by weight.

The compositions may also contain enzymes from the class of proteases, lipases and amylases or their mixtures. Enzymic substances obtained from strains of bacteria or fungi, such as *Bacillus subtilis*, *Bacillus licheniformis* and *Streptomyces griseus* are specially suitable. Further constituents which may be contained in the powder components containing washing agents are neutral salts, especially sodium sulfate, antimicrobial substances, such as halogenated phenolethers and thioethers, halogenated carbanilides and salicylanilides, as well as halogenated diphenylmethanes, also stabilizing agents for percompounds, such as magnesium silicate.

For increasing the dirt-carrying capacity, known greying inhibitors or soil-suspending compounds, especially sodium cellulose glycollate (carboxymethylcellulose) are added.

If desired, the washing compositions may contain known foam-inhibiting means, such as saturated fatty acids or their alkali metal soaps with 20 to 24 carbon atoms, higher molecular weight fatty acid esters or triglycerides, trialkylmelamines or dialkyl and tetraalkyl ureas.

The constituents contained in the powder component containing washing agent may be contained in homogenously composed powder particles. Such powder particles are obtainable, for example, by spray drying or granulation from aqueous concentrates or granulating the remaining constituents on previously formed powders in a known way. The powder component containing washing agent, however, may also consist of granular mixtures, in which the powder particles have a variable composition. Thus, for example, a specified fraction of the powder particles may contain the detergent substances and a part of the builder salts and have been obtained by hot spray drying, while a further part of the particles prepared, for example, by granulation, contains the residue of the builder salts and those active substances which decompose, volatilize or lose activity under the conditions of the hot spray drying as, for example, perfumes, biocides and certain foam inhibitors.

In the complex mixtures, the proportion by weight of the powder component containing washing agent to the sum of the stabilized bleaching assistant, according to the invention, and percompound should amount to 1:2 to 10:1, preferably 1:1 to 5:1.

The bleaching assistants according to the invention as well as their mixtures with percompounds and/or washing agents are marked by a very high stability on storage, i.e., the decline of the bleaching activity occurs considerably more slowly than with known mixtures. The formation of undesired odorous substances by decomposition of components sensitive to oxidation is thereby avoided. On application the mixtures show excellent solubility properties, i.e., they are dissolved without residue within a short time on use. This was all the more surprising since neither the fatty acid nor the alcohol are sufficiently quickly soluble in cold alkali solutions. If, therefore, fatty acid or higher melting fatty alcohols are used alone as coating substances for the bleaching activators, under the same conditions, no solution or only very slow solution takes place. On the other hand, water-soluble ethoxylated alcohols are unsuitable as coating substances, since they do not improve the stability on storage of the bleaching activators.

The preparation of the powder particles is particularly simple in comparison with the known process, in which the bleaching activators are granulated or coated with coating substances, since the use of solvents for the powders and a recovery of the solvents, always combined with losses, is omitted.

The present invention will be further described with reference to the following specific Examples which are not to be deemed limitative of the invention.

EXAMPLE 1

A mixture of 16.8 parts by weight of stearic acid, 16.8 parts by weight of palmitic acid, and 8.4 parts by weight of a tallow fatty alcohol consisting of 60% by weight of stearyl alcohol, 35% by weight of cetyl alcohol, and 5% by weight of myristyl alcohol, was melted at 80° C and then mixed with stirring with 8 parts by weight of a technically pure sodium lauryl sulfate (90% by weight active substance). The viscosity of the mixture rose, and 50 parts by weight of a finely-divided tetraacetyl glycoluril were stirred in. The homogeneous suspension was sprayed through a nozzle with an orifice diameter of 1 mm with a pressure of 20 atm. into an atomizing chamber. The temperature of the cooling air entering the chamber in counter-flow was 18° C, that of the issuing air 20° C. The shakable, non-sticking spray powder had a primarily spherical structure and yielded in a screen analysis the following particle size distribution:

| Screen number (mm) | | % by weight |
|---|---|---|
| to | 1.6 | 0.3 |
| " | 0.8 | 0.3 |
| " | 0.4 | 0.9 |
| " | 0.2 | 32.0 |
| " | 0.1 | 60.1 |
| through | 0.1 | 6.4 |

This product is hereinafter referred to a sprayed product (a).

This uniformity of particle size distribution in the presence of the water-soluble sulfate of the invention is to be compared with the comparable coated particles without use of the water-soluble sulfate.

20 parts by weight of stearic acid, 20 parts by weight of palmitic acid and 10 parts by weight of a tallow fatty alcohol, consisting of 60% by weight of stearyl alcohol, 35% by weight of cetyl alcohol and 5% by weight of myristyl alcohol, were melted at 80° C and, after addition of 50 parts by weight of tetraacetylglycoluril, the suspension was homogenized. The homogenized melt was sprayed by means of a nozzle with an aperture of 1 mm diameter at a pressure of 20 atmospheres into a spraying chamber. The temperature of the cooling air entering the chamber in counter-current was 18 °C, and that of the issuing air 20 °C. The easily pourable non-adhering sprayed powder had mostly a globular structure and gave the following grain distribution on a screen analysis:

| Screen No. (mm) | % (Wt.) |
|---|---|
| 2.0 | 1.8 |
| 1.6 | 3.5 |
| 0.8 | 23.6 |
| 0.4 | 50.9 |
| 0.2 | 19.5 |
| under 0.2 | 0.7 |

The average particle size was 0.6 mm.

20 parts by weight of the sprayed product (a) were mixed with 10 parts by weight of sodium perborate tetrahydrate (b) having a weight per liter of 1000 gm and an average particle size of 0.3 mm, as well as with 63 parts by weight of a washing agent mixture (c) obtained by hot spray drying, having a weight per liter of 420 gm and an average particle size of 0.65 mm. The finished powder mixture had the following composition (data in weight percent):

(a)

10.0% tetraacetylglycoluril
6.7% fatty acid
1.7% tallow fatty alcohol
1.6% Na lauryl sulfate (b)

10.0% sodium perborate tetrahydrate (c)

7.0% n-dodecylbenzensulfate (Na-salt)
2.0% oleyl alcohol with 10 ethoxy units 3.0% tallow soap
35.0% pentasodium tripolyphosphate
8.0% sodium carbonate
3.5% sodium silicate ($Na_2O : SiO_2 = 1:2$)
2.5% magnesium silicate 0.2% Na-ethylenediaminetetraacetate 0.3% optical brightner
1.0% sodium carboxymethylcellulose
7.5% water When this detergent was used in water of 30° C, the bleach activator tetraacetylglycoluril was released shortly after the detergent was introduced into the water.

EXAMPLE 2

Example 1 was repeated, but instead of sodium lauryl sulfate a Na alkyl diethylene glycol ether sulfate from coconut fatty alcohols (55% $C_{12}$, 35% $C_{14}$, 10% $C_{16}$, each saturated), was employed. In this case there was no separation of the melt either. The solubility of the bleaching aid in water of 30° C corresponded to that of Example 1.

Instead of the activators used in the washing composition of Example 1, those in which the tetraacetylglycoluril is replaced by other activators of (a) to (o) may also be used with a similar result.

Cotton brighteners, polyamide brighteners, polyester brighteners and their combinations may be used as optical brighteners, depending upon the purpose for which the washing composition according to the invention is to be used.

If preparations containing enzymes are to be made, 7% to 15% by weight of commercial products are used which, where solid enzyme concentrates are concerned, are adjusted by the manufacturer to the following activities by addition of inorganic salts, mostly sodium sulfate or sodium tripolyphosphate:

A protease with 125,000 LVE/gm,
An amylase with 75,000 SKBE/gm,
A lipase with 10,000 IE/gm.

The preceding specific embodiments are illustrative of the practive of the invention. It is to be understood, however, that other expedients known to tose skilled in the art or disclosed herein may be employed without departing from the spirit of the invention or the scope of the appended claims.

We claim:

1. A coated stabilized bleaching assistant suitable for use in pulverulent washing and bleaching compositions comprising drop-shaped to globular-shaped particles having an average diameter of 0.01 mm to 2.5 mm, and at least 70% of which have a diameter within the range of 0.1 to 1 mm consisting essentially of 10 to 70% by weight of at least one activator for active oxygen derived from compounds yielding $H_2O_2$ in aqueous solutions having an activating action of at least 3 in the Per-Acid Formation Test selected from the group consisting of (1) N-acyl compounds having 2 to 9 carbon atoms in the acyl, (2) O-acyl compounds having 2 to 9 carbon atoms in the acyl, wherein acyl is an organic group of the formula $$R - CO -$$

wherein R designates the hydrocarbon radical with from 1 to 8 carbon atoms, optionally substituted with alkoxy having 1 to 3 carbon atoms, halo, nitro or cyano, (3) carbonic acid esters of the formula $$X - O - CO - O - R$$

wherein X is an electron-attracting residue selected from the group consisting of p-carboxyphenyl, p-sulfophenyl and alkoxycarbonyl with 1 to 4 carbon atoms in the alkoxy and R has the above-assigned values, and (4) pyrocarbonic acid esters of $C_1$ to $C_4$ alkanols, substantially surrounded by from 30 to 90% by weight of a mixture of (a) from 2 to 10parts by weight of said mixture of acids having substantially from 12 to 24 carbon atoms selected from the group consisting of substantially saturated fatty acids, saturated hydroxy fatty acids, and mixtures thereof, (b) 1 part of weight of said mixture of alcohols selected from the group consisting of substantially saturated hydrocarbon monohydric alcohols having from 10 to 20 carbon atoms, their ethoxylated products, their propoxylated products and mixtures thereof, where the alkoxylated products are water-insoluble and have from 1 to 5 alkoxy units, and (c) from 5 to 25% by weight of said mixture of water-soluble sulfates of alcohols selected from the group consisting of substantially saturated hydrocarbon monohydric alcohols having from 8 to 18 carbon atoms, their ethoxylated products, their propoxylated products and mixtures thereof, where the alkoxylated products have from 1 to 5 alkoxy units.

2. The coated stabilized bleaching assistant of claim 1 wherein said component (c) of said mixture is present in an amount of from 10 to 20% by weight.

3. The coated stabilized bleaching assistant of claim 1 wherein said mixture of acids and alcohols contains from 3 to 5 parts by weight of said acids to 1 part by weight of said alcohols.

4. The coated stabilized bleaching assistant of claim 1 wherein said alcohol is a primary alkanol having 12 to 18 carbon atoms.

5. The coated stabilized bleaching assistant of claim 1 wherein said alcohol is an ethylene oxide adduct of a primary alkanol having 12 to 18 carbon atoms adducted with 1 to 3 ethoxy units.

6. The coated stabilized bleaching assistant of claim 1 wherein at least 90% by weight of said particles have a diameter within the range of 0.1 mm to 1.6 mm.

7. The coated stabilized bleaching assistant of claim 1 wherein said at least one activator has a melting point of at least 100° C, and said mixture of acids, alcohols and water-soluble sulfates has a softening or melting point of above 40° C.

8. The coated stabilized bleaching assistant of claim 1 wherein said activator is tetraacetylglycoluril.

9. A washing and bleaching agent consisting of (I) from 5 to 95% by weight of said coated stabilized bleaching assistant of claim 1, and (II) from 5 to 95% by weight of at least one of the following: (a) alkali metal inorganic builder salts, (b) percompounds giving $H_2O_2$ in aqueous solutions and stabilizers for percompounds, (c) tensides selected from the group consisting of anionic surface-active compounds, nonionic surface-active compounds and amphoteric surface-active compounds, (d) optical brighteners, (e) water-soluble organic builder salts, (f) antimicrobial agents, (g) soil suspension agents, (h) enzymes, (i) foam stabilizers, (j) non-surface-active foam inhibitors, (k) textile softeners, and (l) corrosion inhibitors.

10. The washing and bleaching agent of claim 9 wherein said component II consists essentially of a granular to pulverulent compound, which liberates hydrogen peroxide in aqueous solution, the ratio by weight of the assistant to the percompound being 1:5 to 5:1 and is chosen so that 0.05 to 2 mols of activator are present per gram atom of active oxygen.

11. The washing and bleaching agent of claim 10 wherein said amount of said assistant is chosen so that 0.1 to 1 mol of activator are present per gram atom of active oxygen.

12. The washing and bleaching agent of claim 10 wherein said percompound is sodium perborate with or without water of crystallization.

13. The washing and bleaching agent of claim 10 having at least one other constituent of component II which is granular and formed by spray-drying an aqueous solution thereof.

14. The washing and bleaching agent of claim 13 wherein at least 50% by weight of said granular further constituents have a diameter of between 0.05 mm and 2.5 mm.

* * * * *